US010757979B2

(12) United States Patent
Zhu

(10) Patent No.: US 10,757,979 B2
(45) Date of Patent: Sep. 1, 2020

(54) ELECTROMAGNETIC VAPORIZER AND ELECTRONIC CIGARETTES HAVING THE SAME

(71) Applicant: SHENZHEN KANGER TECHNOLOGY CO., LTD., Shenzhen (CN)

(72) Inventor: Xiaochun Zhu, Shenzhen (CN)

(73) Assignee: SHENZHEN KANGER TECHNOLOGY CO., LTD., Shenzhen (CN)

( * ) Notice: Subject to any disclaimer, the term of this patent is extended or adjusted under 35 U.S.C. 154(b) by 353 days.

(21) Appl. No.: 15/990,748

(22) Filed: May 28, 2018

(65) Prior Publication Data

US 2019/0357592 A1 Nov. 28, 2019

(30) Foreign Application Priority Data

May 25, 2018 (CN) ..... 2018 1 0515782

(51) Int. Cl.
*A24F 47/00* (2020.01)
*H05B 6/10* (2006.01)
*A24B 15/167* (2020.01)

(52) U.S. Cl.
CPC ..... *A24F 47/008* (2013.01); *A24B 15/167* (2016.11); *H05B 6/108* (2013.01)

(58) Field of Classification Search
CPC ..... A24F 47/008
See application file for complete search history.

(56) References Cited

U.S. PATENT DOCUMENTS 5,610,958 A * 3/1997 Shimano ..... F04B 49/10 376/277
6,809,494 B1 * 10/2004 Hattori ..... H02P 5/46 318/249
2017/0106759 A1 * 4/2017 Yamakawa ..... B60L 53/126
2018/0360120 A1 * 12/2018 Huang ..... A24F 47/008
2019/0357592 A1 * 11/2019 Zhu ..... A24B 15/167
2020/0060348 A1 * 2/2020 Mironov ..... A24F 47/008
2020/0093177 A1 * 3/2020 Han ..... A24D 3/08
2020/0128878 A1 * 4/2020 Stura ..... A24F 47/008

* cited by examiner

*Primary Examiner* — James Harvey
(74) *Attorney, Agent, or Firm* — Ming Jiang; MM IP Services LLC

(57) ABSTRACT

Aspects of the present disclosure relate to electromagnetic vaporizer assembly, electronic cigarette having electromagnetic vaporizer assembly, and methods of using the same. In certain embodiments, electromagnetic vaporizer assembly includes: an electromagnetic vaporizer, and an electromagnetic heating controller. Electromagnetic vaporizer includes an electromagnetic heating coil to heat a cigarette. Electromagnetic heating controller allows a user to control and use an electronic cigarette having electromagnetic vaporizer assembly. When user inserts the cigarette into a cigarette holder, and presses a push button, the electromagnetic heating controller provides a predetermined AC voltage to the electromagnetic heating coil to heat up the cigarette, and the user enjoys vaporized cigarette. The electromagnetic heating controller includes: a switch circuit to allow user to turn on or off a DC power source to the electromagnetic vaporizer and a DC to AC converter to convert the DC power source to the predetermined AC voltage for the electromagnetic heating coil.

20 Claims, 4 Drawing Sheets

ELECTROMAGNETIC VAPORIZER AND ELECTRONIC CIGARETTES HAVING THE SAME

FIELD

The present disclosure generally relates to the field of electronic cigarettes, and more particularly to an electromagnetic vaporizer, electronic cigarettes having the electromagnetic vaporizer, and the methods of using electronic cigarettes having the electromagnetic vaporizer.

BACKGROUND

It is well known that smoking cigarette is harmful to smoker's health. The active ingredient in a cigarette is mainly nicotine. During smoking, nicotine, along with tar aerosol droplets produced in the cigarette burning, are breathed into the alveolus and absorbed quickly by the smoker. Once nicotine is absorbed into the blood of the smoker, nicotine then produces its effect on the receptors of the smoker's central nervous system, causing the smoker relax and enjoy an inebriety similar to that produced by an exhilarant.

The electronic cigarette is sometimes referred as electronic vaporing device, personal vaporizer (PV), or electronic nicotine delivery system (ENDS). It is a battery-powered device which simulates tobacco smoking. It generally uses a heating element that vaporizes a liquid solution (e-liquid). Some solutions contain a mixture of nicotine and a variety of flavorings, while others release a flavored vapor without nicotine. Many are designed to simulate smoking experience, such as cigarette smoking or cigar smoking. Some of them are made with similar appearance, while others are made considerably different in appearance.

Conventional electronic cigarettes use a resistive heater to heat E-liquid in the electronic cigarette. This type of resistive heater has low energy efficiency, rate of temperature rise is low, is unable to reach very high temperature in a short period of time. The lifespan of this type of resistive heater is short. It is desirable to have an electronic cigarette that consumes less energy, rises the temperature in a rapid rate, reaches high temperature in a relatively short period of time, and has long lifespan.

Therefore, an unaddressed need exists in the art to address the aforementioned deficiencies and inadequacies.

SUMMARY

In one aspect, the present disclosure relates to an electromagnetic vaporizer assembly. In certain embodiments, the electromagnetic vaporizer assembly includes: an electromagnetic vaporizer, and an electromagnetic heating controller. The electromagnetic vaporizer includes an electromagnetic heating coil to heat a cigarette. The electromagnetic heating controller allows a user to control and use an electronic cigarette having the electromagnetic vaporizer assembly. When the user inserts the cigarette into a cigarette holder, and presses a push button, the electromagnetic heating controller provides a predetermined AC voltage to the electromagnetic heating coil to heat up the cigarette, and the user enjoys vaporized cigarette.

In certain embodiments, the electromagnetic heating controller includes: a switch circuit and a DC to AC converter. The switch circuit allows the user to turn on or off a direct-current (DC) power source to the electromagnetic vaporizer. The DC to AC converter converts the DC power source to the predetermined AC voltage for the electromagnetic heating coil.

In certain embodiments, the switch circuit includes a push button switch. The push button switch may include two switching modes. In one embodiment, the push button switch is turned on by a first push of the push button, and turned off by a second push of the push button. In another embodiment, the push button switch is turned on by a push on the push button and hold, and turned off by releasing the push on the push button.

In one embodiment, the DC power source includes a battery. In another embodiment, the DC power source includes a rechargeable battery. In certain embodiments, the rechargeable battery may include including lead-acid battery, nickel cadmium (NiCd) battery, nickel metal hydride (NiMH) battery, lithium ion (Li-ion) battery, and lithium ion polymer (Li-ion polymer) battery.

In certain embodiments, the cigarette may include cigarette leaves, marijuana, tobacco wax, and electronic cigarette liquid (e-liquid).

In certain embodiments, the electromagnetic vaporizer includes: the cigarette holder, a coil holder, and a heat insulator. The cigarette holder has a cylindrical body with an open top and a closed bottom. The cigarette holder is made of low resistance metal to generate heat through electromagnetic field produced by the electromagnetic heating coil. The cigarette holder may be made of one or more of following materials: aluminum (Al), Chromium (Cr), Manganese (Mn), Iron (Fe), Cobalt (Co), Nickel (Ni), Copper (Cu), Zirconium (Zr), Niobium (Nb), Molybdenur (Mo), Rhenium (Re), Silver (Ag), Cadmium (Cd), Tantalum (Ta), Tungsten (W), Iridium (Ir), Platinum (Pt), Gold (Au), and alloys of these materials.

The coil holder is positioned immediately outside of the cylindrical body of the cigarette holder and in direct contact with the cylindrical body of the cigarette holder. The electromagnetic heating coil is wound around the coil holder. The heat insulator is wrapped around the electromagnetic heating coil to prevent the heat generated by the electromagnetic heating coil from radiating to surrounding area.

In certain embodiments, the cigarette holder defines one or more venting openings. In one embodiment, the venting openings are defined on the closed bottom of the cigarette holder for cigarette having cigarette leaves, and marijuana. In another embodiment, the venting openings are defined on side wall of the cylindrical body of the cigarette holder for cigarette having tobacco wax, and e-liquid.

In another aspect, the present disclosure relates to an electronic cigarette. In certain embodiments, the electronic cigarette includes: an electronic cigarette body, and an electromagnetic vaporizer assembly. The electronic cigarette body enclose the electromagnetic vaporizer assembly to form the electronic cigarette. In certain embodiments, the electronic cigarette body includes: an electronic cigarette top cover, an electronic cigarette bottom cover, and a controller circuit support. The electronic cigarette body has a top end and a bottom end. The top end of the electronic cigarette body is covered by the electronic cigarette top cover, and the bottom end of the electronic cigarette body is covered by the electronic cigarette bottom cover. The controller circuit support holds a DC power source, and an electronic circuit board for the electromagnetic heating controller and a push button switch.

In certain embodiments, the electromagnetic vaporizer assembly includes: an electromagnetic vaporizer, and an electromagnetic heating controller. The electromagnetic vaporizer includes an electromagnetic heating coil to heat a cigarette. The electromagnetic heating controller allows a user to control and use an electronic cigarette having the electromagnetic vaporizer assembly. When the user inserts the cigarette into a cigarette holder, and presses a push button, the electromagnetic heating controller provides a predetermined AC voltage to the electromagnetic heating coil to heat up the cigarette, and the user enjoys vaporized cigarette.

In certain embodiments, the electromagnetic heating controller includes: a switch circuit and a DC to AC converter. The switch circuit allows the user to turn on or off a direct-current (DC) power source to the electromagnetic vaporizer. The DC to AC converter converts the DC power source to the predetermined AC voltage for the electromagnetic heating coil.

In certain embodiments, the switch circuit includes a push button switch. The push button switch may include two switching modes. In one embodiment, the push button switch is turned on by a first push of the push button, and turned off by a second push of the push button. In another embodiment, the push button switch is turned on by a push on the push button and hold, and turned off by releasing the push on the push button.

In one embodiment, the DC power source includes a battery. In another embodiment, the DC power source includes a rechargeable battery. In certain embodiments, the rechargeable battery may include including lead-acid battery, nickel cadmium (NiCd) battery, nickel metal hydride (NiMH) battery, lithium ion (Li-ion) battery, and lithium ion polymer (Li-ion polymer) battery.

In certain embodiments, the cigarette may include cigarette leaves, marijuana, tobacco wax, and electronic cigarette liquid (e-liquid).

In certain embodiments, the electromagnetic vaporizer includes: the cigarette holder, a coil holder, and a heat insulator. The cigarette holder has a cylindrical body with an open top and a closed bottom. The cigarette holder is made of low resistance metal to generate heat through electromagnetic field produced by the electromagnetic heating coil. The cigarette holder may be made of one or more of following materials: aluminum (Al), Chromium (Cr), Manganese (Mn), Iron (Fe), Cobalt (Co), Nickel (Ni), Copper (Cu), Zirconium (Zr), Niobium (Nb), Molybdenur (Mo), Rhenium (Re), Silver (Ag), Cadmium (Cd), Tantalum (Ta), Tungsten (W), Iridium (Ir), Platinum (Pt), Gold (Au), and alloys of these materials.

The coil holder is positioned immediately outside of the cylindrical body of the cigarette holder and in direct contact with the cylindrical body of the cigarette holder. The electromagnetic heating coil is wound around the coil holder. The heat insulator is wrapped around the electromagnetic heating coil to prevent the heat generated by the electromagnetic heating coil from radiating to surrounding area.

In certain embodiments, the cigarette may include cigarette leaves, marijuana, tobacco wax, and electronic cigarette liquid (e-liquid).

In certain embodiments, the cigarette holder defines one or more venting openings. In one embodiment, the venting openings are defined on the closed bottom of the cigarette holder for cigarette having cigarette leaves, and marijuana. In another embodiment, the venting openings are defined on side wall of the cylindrical body of the cigarette holder for cigarette having tobacco wax, and e-liquid.

In yet another aspect, the present disclosure relates to a method of using an electronic cigarette having an electromagnetic vaporizer assembly. In certain embodiments, the method includes: inserting, by a user, a cigarette into a cigarette holder of the electronic cigarette, pressing, by the user, a push button switch on the electronic cigarette to turn on a DC power source to an electromagnetic heating controller, generating, by the electromagnetic heating controller, a predetermined AC voltage to drive an electromagnetic heating coil of the electromagnetic vaporizer assembly, and vaporizing, by the electromagnetic vaporizer assembly, the cigarette to allow the user to enjoy the cigarette vapor.

In certain embodiments, the cigarette may include cigarette leaves, marijuana, tobacco wax, and electronic cigarette liquid (e-liquid).

In certain embodiments, the electronic cigarette includes: an electronic cigarette body, and the electromagnetic vaporizer assembly. The electronic cigarette body encloses the electronic cigarette. The electromagnetic vaporizer assembly has an electromagnetic vaporizer, and the electromagnetic heating controller. The electromagnetic vaporizer has an electromagnetic heating coil to heat the cigarette. The electromagnetic heating controller provides the predetermined AC voltage for the electromagnetic heating coil, and allows a user to control and use the electronic cigarette.

These and other aspects of the present disclosure will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and, together with the written description, serve to explain the principles of the disclosure. Wherever possible, the same reference numbers are used throughout the drawings to refer to the same or like elements of an embodiment. The drawings do not limit the present disclosure to the specific embodiments disclosed and described herein. The drawings are not necessarily to scale, emphasis instead being placed upon clearly illustrating the principles of the disclosure, and wherein.

DETAILED DESCRIPTION

Figure 1:
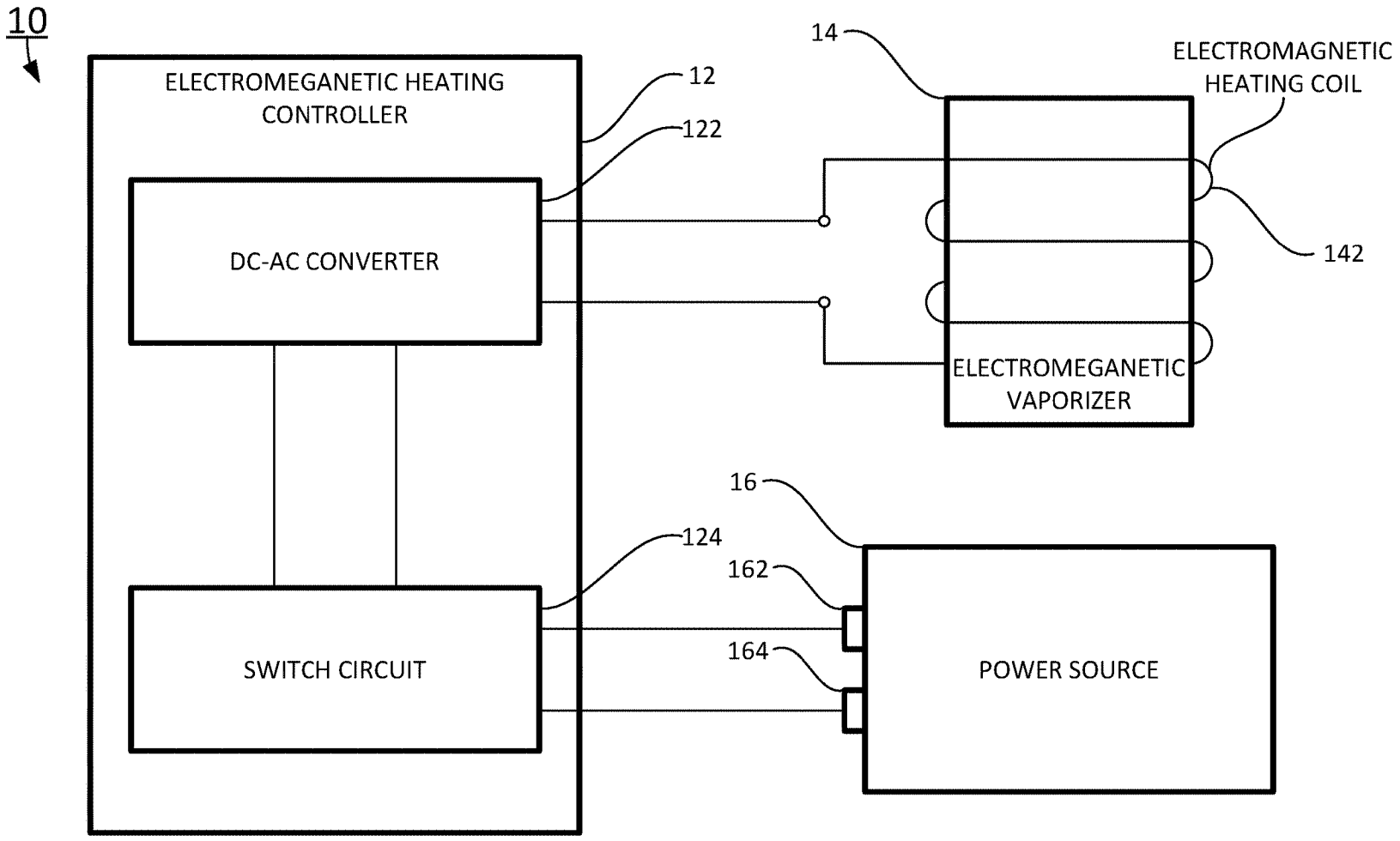
FIG. 1 shows a block diagram of an electromagnetic vaporizer assembly according to certain embodiments of the present disclosure.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present disclosure be fully understood, but the present disclosure may also be implemented by using other manners different from those described herein, so that the present disclosure is not limited by the specific embodiments disclosed in the following.

The description will be made as to the embodiments of the present disclosure in conjunction with the accompanying drawings FIGS. 1 through 4.

In one aspect, the present disclosure relates to an electromagnetic vaporizer assembly 10, as shown in FIG. 1. In certain embodiments, the electromagnetic vaporizer assembly 10 includes: an electromagnetic vaporizer 14, and an electromagnetic heating controller 12. The electromagnetic vaporizer 14 includes an electromagnetic heating coil 142 to heat and vaporize a cigarette 200. The electromagnetic heating controller 12 allows a user to control and use an electronic cigarette 100 having the electromagnetic vaporizer assembly 10. When the user inserts the cigarette 200 into a cigarette holder 108 of the electromagnetic vaporizer assembly 10, and presses a push button 114, the electromagnetic heating controller 12 provides a predetermined AC voltage to the electromagnetic heating coil 142 to heat up and vaporize the cigarette 200 such that the user may enjoy the vaporized cigarette 200.

In certain embodiments, the electromagnetic heating controller 12 includes: a switch circuit 124 and a DC to AC converter 122. The switch circuit 124 allows the user to turn on or off a direct-current (DC) power source 16 to the electromagnetic vaporizer 14. The DC to AC converter 122 converts the DC power source 16 to the predetermined AC voltage for the electromagnetic heating coil 142. The predetermined AC voltage is produced and calibrated to generate rapid temperature rise, and raise and maintain the electromagnetic vaporizer at a predetermined temperature to optimize the vaporization of the cigarette 200.

In certain embodiments, the switch circuit 124 includes a push button switch 116. The push button switch 116 may include two switching modes. In one embodiment, the push button switch 116 is turned on by a first push of the push button 114, and turned off by a second push of the push button 114. In another embodiment, the push button switch 116 is turned on by a push and hold on the push button 114, and turned off by releasing the hold on the push button 114.

In one embodiment, the DC power source 16 is a battery. In another embodiment, the DC power source 16 is a rechargeable battery. In certain embodiments, the rechargeable battery may include including lead-acid battery, nickel cadmium (NiCd) battery, nickel metal hydride (NiMH) battery, lithium ion (Li-ion) battery, and lithium ion polymer (Li-ion polymer) battery.

In certain embodiments, the cigarette 200 may include cigarette leaves, marijuana, tobacco wax, and electronic cigarette liquid (e-liquid).

Figure 2:
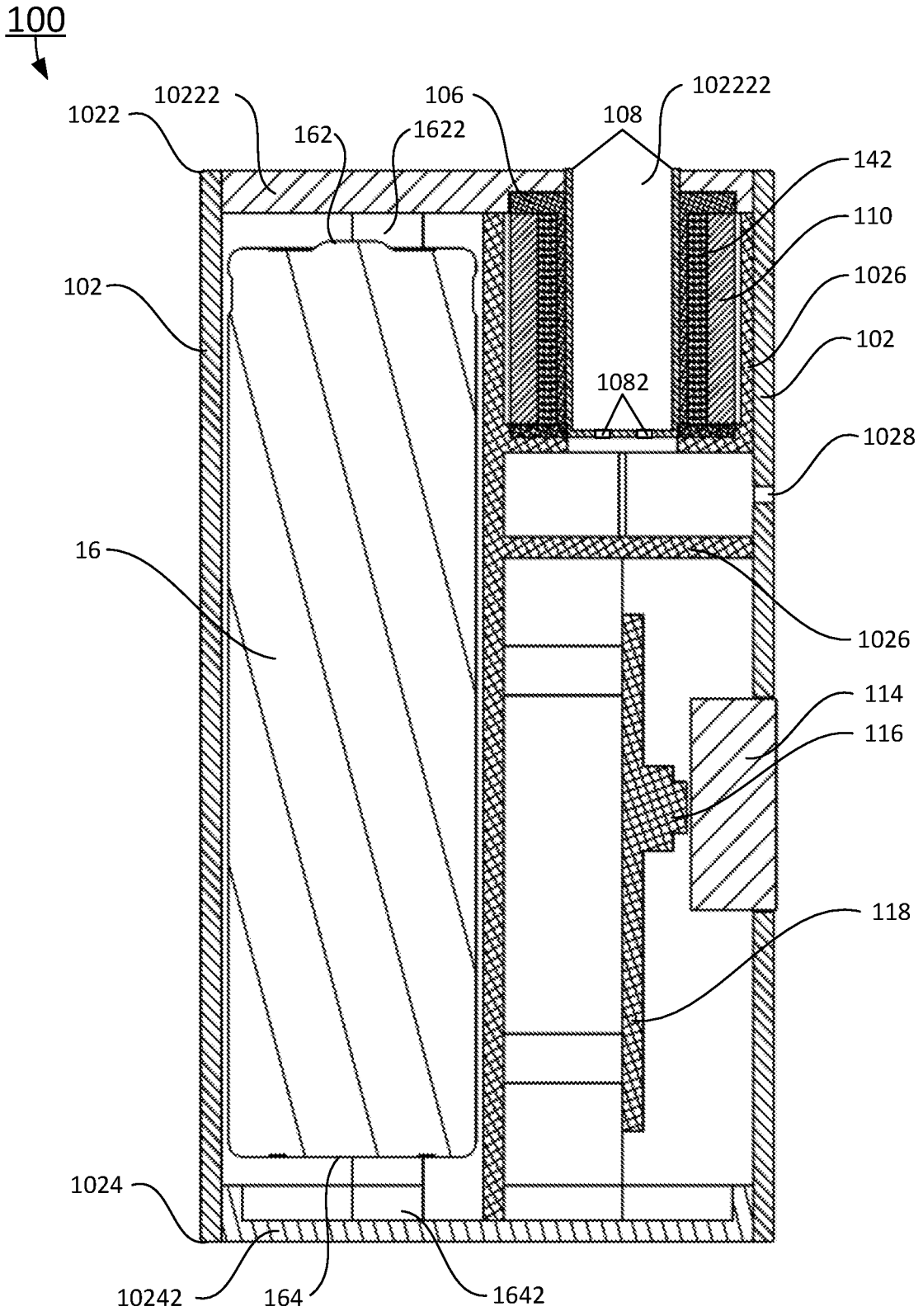
FIG. 2 is a sectional view of an exemplary electronic cigarette having the electromagnetic vaporizer assembly according to certain embodiments of the present disclosure.
Figure 3:
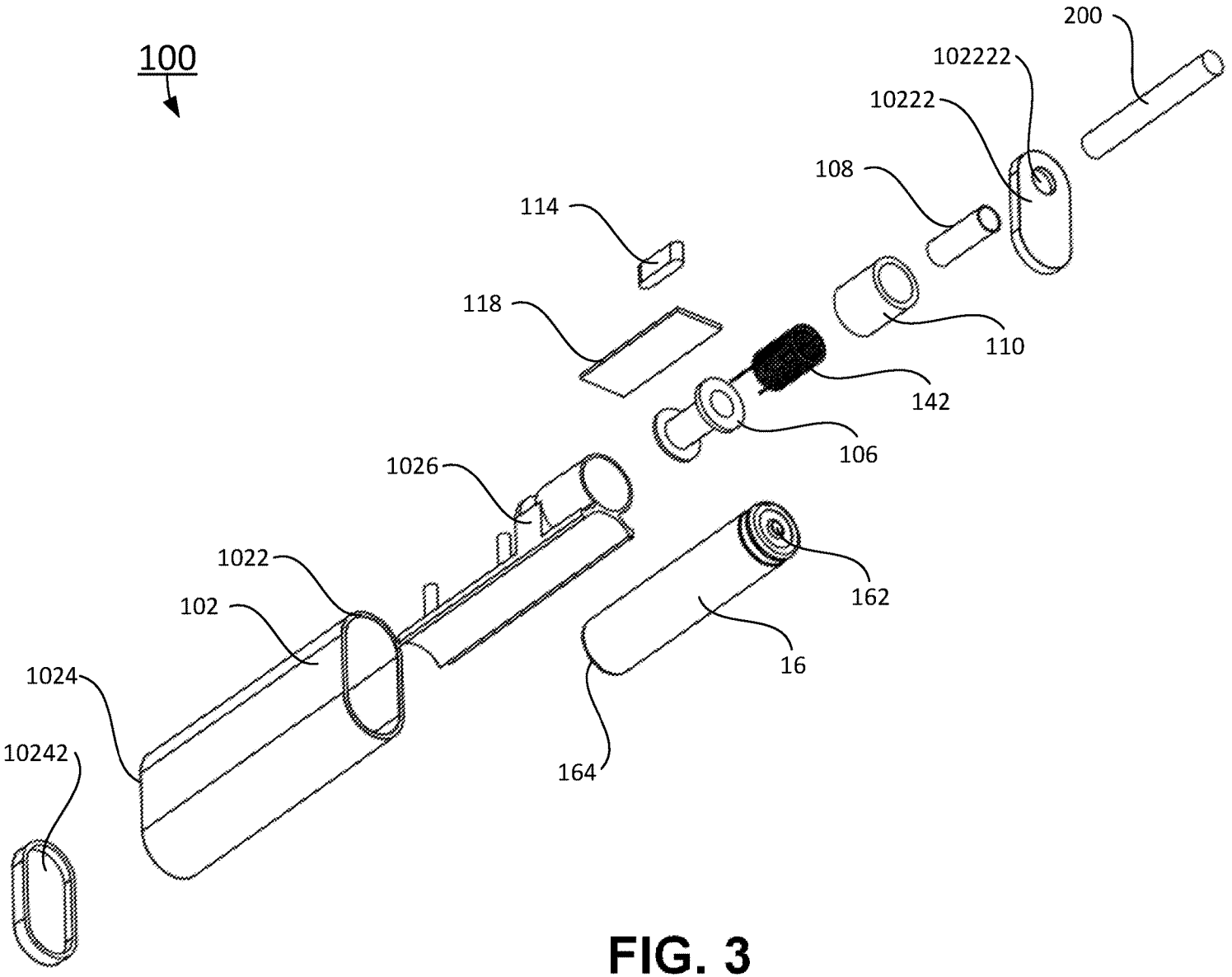
FIG. 3 is an exploded perspective view of an exemplary electronic cigarette having the electromagnetic vaporizer assembly according to certain embodiments of the present disclosure.

Referring now to FIG. 2 and FIG. 3, in certain embodiments, the electromagnetic vaporizer 14 includes: the cigarette holder 108, a coil holder 106, and a heat insulator 110. The cigarette holder 108 has a cylindrical body with an open top and a closed bottom. The cigarette holder 108 is made of low resistance metal to generate heat through electromagnetic field produced by the electromagnetic heating coil 142. The cigarette holder 108 may be made of one or more of following materials: aluminum (Al), Chromium (Cr), Manganese (Mn), Iron (Fe), Cobalt (Co), Nickel (Ni), Copper (Cu), Zirconium (Zr), Niobium (Nb), Molybdenur (Mo), Rhenium (Re), Silver (Ag), Cadmium (Cd), Tantalum (Ta), Tungsten (W), Iridium (Ir), Platinum (Pt), Gold (Au), and alloys of these materials.

In certain embodiments, the cigarette holder 108 defines one or more venting openings. In one embodiment, the venting openings 1082 are defined on the closed bottom of the cigarette holder 108 for cigarette 200 having cigarette leaves, and marijuana. In another embodiment, the venting openings (not shown in FIG. 2) are defined on side wall of the cylindrical body of the cigarette holder 108 for cigarette 200 having tobacco wax, and e-liquid.

The coil holder 106 is positioned immediately outside of the cylindrical body of the cigarette holder 108 and in direct contact with the cylindrical body of the cigarette holder 108. The electromagnetic heating coil 142 is wound around the coil holder 106. The heat insulator 110 is wrapped around the electromagnetic heating coil 142 to prevent the heat generated by the electromagnetic heating coil 142 from radiating to surrounding area.

In another aspect, as shown in FIG. 2 and FIG. 3, the present disclosure relates to an electronic cigarette 100. In certain embodiments, the electronic cigarette 100 includes: an electronic cigarette body 102, and an electromagnetic vaporizer assembly 10. The electronic cigarette body 102 enclose the electromagnetic vaporizer assembly 10 to form the electronic cigarette 100. The electronic cigarette body 102 has a top end 1022 and a bottom end 1024. In certain embodiments, the electronic cigarette body 102 includes: an electronic cigarette top cover 10222, an electronic cigarette bottom cover 10242, and a controller circuit support 1026. The top end 1022 of the electronic cigarette body 102 is covered by the electronic cigarette top cover 10222, and the bottom end 1024 of the electronic cigarette body 102 is covered by the electronic cigarette bottom cover 10242. The electronic cigarette top cover 10222 defines a cigarette opening 102222, and the cigarette opening 102222 allows the user to insert the cigarette 200 into a cigarette holder 108. The controller circuit support 1026 holds a DC power source 16, an electronic circuit board 118 of the electromagnetic heating controller 12 and a push button switch 116.

In certain embodiments, the electromagnetic vaporizer assembly 10 includes: an electromagnetic vaporizer 14, and an electromagnetic heating controller 12. The electromagnetic vaporizer 14 includes an electromagnetic heating coil 142 to heat a cigarette 200. The electromagnetic heating controller 12 allows a user to control and use the electronic cigarette 100 having the electromagnetic vaporizer assembly 10. When the user inserts the cigarette 200 into the cigarette holder 108 through the cigarette opening 102222 on the electronic cigarette top cover 10222, and presses a push button 114 coupled to the push button switch 116, the electromagnetic heating controller 12 provides a predetermined AC voltage to the electromagnetic heating coil 142 to heat up and vaporize the cigarette 200, and the user enjoys the vapor generated by the vaporized cigarette 200.

In certain embodiments, the electromagnetic heating controller 12 includes: a switch circuit 124 and a DC to AC converter 122. The switch circuit 124 allows the user to turn on or off a DC power source 16 to the electromagnetic vaporizer 14. The DC to AC converter 122 converts the DC voltage of the DC power source 16 to the predetermined AC voltage for the electromagnetic heating coil 142.

In certain embodiments, the switch circuit 124 includes a push button switch 116. The push button switch 116 may include two switching modes. In one embodiment, the push button switch 116 is turned on by a first push of the push button 114, and turned off by a second push of the push button 114. In another embodiment, the push button switch 116 is turned on by a push and hold on the push button 114, and turned off by releasing the hold on the push button 114.

In one embodiment, the DC power source 16 includes a battery. In another embodiment, the DC power source 16 includes a rechargeable battery. In certain embodiments, the rechargeable battery may include including lead-acid battery, nickel cadmium (NiCd) battery, nickel metal hydride (NiMH) battery, lithium ion (Li-ion) battery, and lithium ion polymer (Li-ion polymer) battery. The DC power source 16 has a positive terminal 162 and a negative terminal 164. The positive terminal 162 of the DC power source 16 is connected to a positive terminal of the electronic circuit board 118 of the electromagnetic heating controller 12 through a positive terminal contact 1622. The negative terminal 164 of the DC power source 16 is connected to a negative terminal of the electronic circuit board 118 of the electromagnetic heating controller 12 through a negative terminal contact 1642. In one embodiment, the electronic cigarette body 102 is also connected the negative terminal 164 of the DC power source 16.

In certain embodiments, the cigarette 200 may include cigarette leaves, marijuana, tobacco wax, and electronic cigarette liquid (e-liquid).

In certain embodiments, the electromagnetic vaporizer 14 includes: the cigarette holder 108, a coil holder 106, and a heat insulator 110. The cigarette holder 108 has a cylindrical body with an open top and a closed bottom. The cigarette holder 108 is made of low resistance metal to generate heat through electromagnetic field produced by the electromagnetic heating coil 142. The cigarette holder 108 may be made of one or more of following materials: aluminum (Al), Chromium (Cr), Manganese (Mn), Iron (Fe), Cobalt (Co), Nickel (Ni), Copper (Cu), Zirconium (Zr), Niobium (Nb), Molybdenur (Mo), Rhenium (Re), Silver (Ag), Cadmium (Cd), Tantalum (Ta), Tungsten (W), Iridium (Ir), Platinum (Pt), Gold (Au), and alloys of these materials.

The coil holder 106 is positioned immediately outside of the cylindrical body of the cigarette holder 108 and in direct contact with the cylindrical body of the cigarette holder 108. The electromagnetic heating coil 142 is wound around the coil holder 106. The heat insulator 110 is wrapped around the electromagnetic heating coil 142 to prevent the heat generated by the electromagnetic heating coil 142 from radiating to surrounding area.

In certain embodiments, the cigarette holder 108 defines one or more venting openings. In one embodiment, the venting openings 1082 are defined on the closed bottom of the cigarette holder 108 for cigarette 200 having cigarette leaves, and marijuana. In another embodiment, the venting openings are defined on side wall of the cylindrical body of the cigarette holder 108 for cigarette 200 having tobacco wax, and e-liquid. The electronic cigarette body 102 includes one or more venting openings 1028 of the electronic cigarette body 102. The outside air comes into the electronic cigarette body 102 through the one or more venting openings 1028 of the electronic cigarette body 102, and goes through the venting openings 1082 of the cigarette holder 108 to the cigarette 200 to provide the user with the vapor generated by the electromagnetic vaporizer 14.

Figure 4:
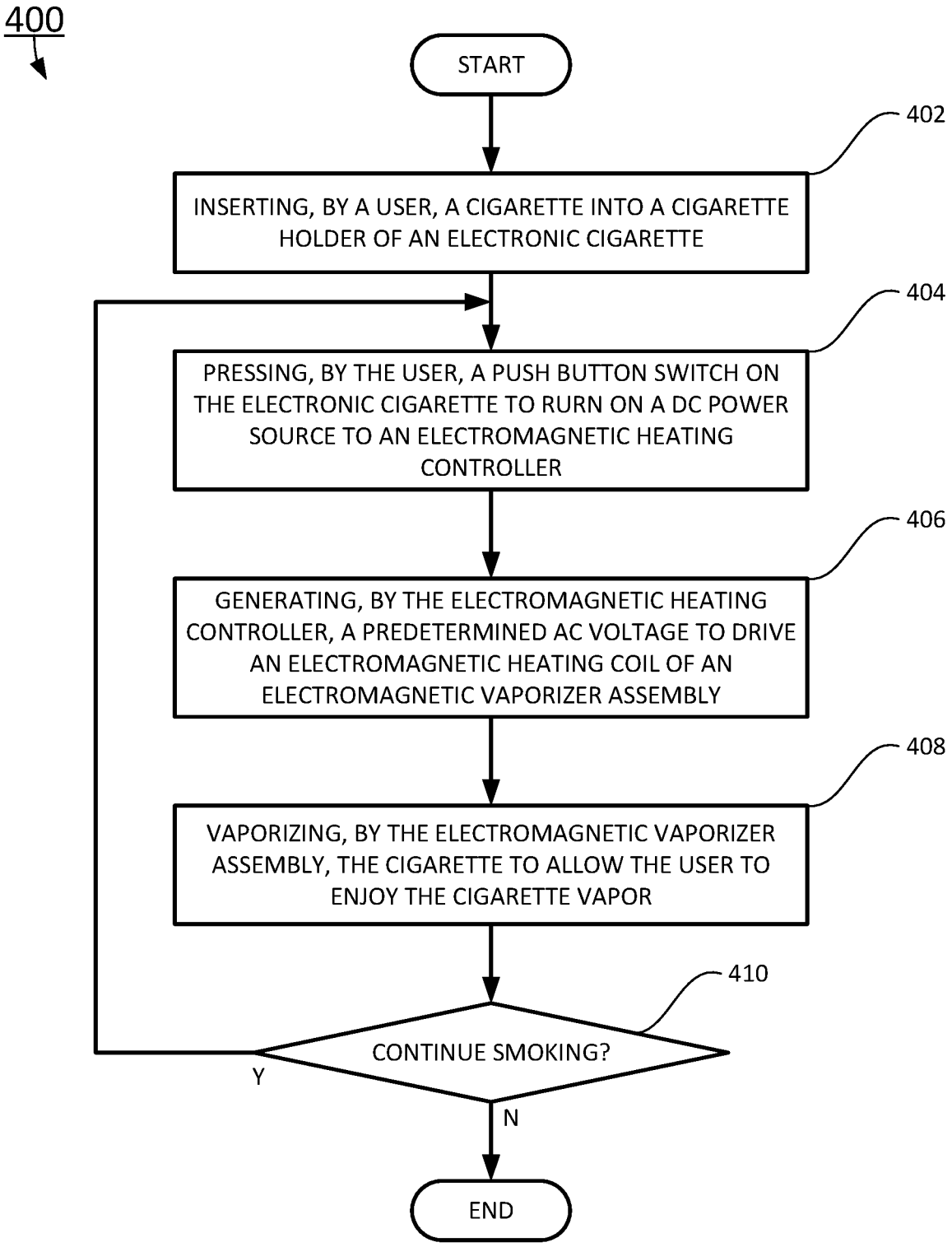
FIG. 4 is a flow chart of an exemplary method of using the electronic cigarette having the electromagnetic vaporizer assembly according to certain embodiments of the present disclosure.

In yet another aspect, as shown in FIG. 4, the present disclosure relates to a method 400 of using an electronic cigarette 100 having an electromagnetic vaporizer assembly 10.

At block 402, a user inserts a cigarette 200 into a cigarette holder 108 of the electronic cigarette 100 through a cigarette opening 102222 on an electronic cigarette top cover 10222 of an electronic cigarette body 102 of the electronic cigarette 100. In certain embodiments, the cigarette 200 may include cigarette leaves, marijuana, tobacco wax, and electronic cigarette liquid (e-liquid).

At block 404, the user presses a push button 114 coupled to a push button switch 116 on the electronic cigarette body 102 of the electronic cigarette 100 to turn on a DC power source 16 to an electromagnetic heating controller 12. The push button switch 116 may include two switching modes. In one embodiment, the push button switch 116 is turned on by a first push of the push button 114, and turned off by a second push of the push button 114. In another embodiment, the push button switch 116 is turned on by a push and hold on the push button 114, and turned off by releasing the hold on the push button 114.

In one embodiment, the DC power source 16 includes a battery. In another embodiment, the DC power source 16 includes a rechargeable battery. In certain embodiments, the rechargeable battery may include including lead-acid battery, nickel cadmium (NiCd) battery, nickel metal hydride (NiMH) battery, lithium ion (Li-ion) battery, and lithium ion polymer (Li-ion polymer) battery.

At block 406, once the electromagnetic heating controller 12 is powered on, the electromagnetic heating controller 12 generates a predetermined AC voltage to drive an electromagnetic heating coil 142 of the electromagnetic vaporizer assembly 10.

At block 408, the electromagnetic vaporizer assembly 10 generates heat through the electromagnetic heating coil 142 which converts electrical energy to heat and heats up and vaporizes the inserted cigarette 200 in the cigarette hold 108. The vaporized cigarette 200 provides cigarette vapor for the user to enjoy.

At query block 410, the user determines whether to continue to smoke. If the user determines to continue, the method 400 returns to block 404. Otherwise, the method 400 ends.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to activate others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims, the foregoing description and the exemplary embodiments described therein, and accompanying drawings.

What is claimed is:

1. An electromagnetic vaporizer assembly, comprising:

an electromagnetic vaporizer having an electromagnetic heating coil to heat a cigarette; and an electromagnetic heating controller to allow a user to control and use an electronic cigarette, wherein when the user inserts the cigarette into a cigarette holder of the electronic cigarette, and presses a push button on the electronic cigarette, the electromagnetic heating controller provides a predetermined AC voltage to the electromagnetic heating coil to heat up the cigarette, and the user enjoys vaporized cigarette.

2. The electromagnetic vaporizer assembly of claim 1, wherein the electromagnetic heating controller comprises:

a switch circuit to allow the user to turn on or off a direct-current (DC) power source to the electromagnetic vaporizer; and a DC to alternate-current (AC) converter to convert the DC power source to the predetermined AC voltage for the electromagnetic heating coil.

3. The electromagnetic vaporizer assembly of claim 2, wherein the switch circuit comprises a push button switch, wherein the push button switch comprises two switching modes: a first push on and a second push off, and one push and hold on and release the hold off.

4. The electromagnetic vaporizer assembly of claim 2, wherein the DC power source comprises a battery and a rechargeable battery.

5. The electromagnetic vaporizer assembly of claim 1, wherein the cigarette comprises cigarette leaves, marijuana, tobacco wax, and electronic cigarette liquid (e-liquid).

6. The electromagnetic vaporizer assembly of claim 1, wherein the electromagnetic vaporizer comprises:

the cigarette holder having a cylindrical body and a closed bottom, wherein the cigarette holder is made of low resistance metal to generate heat through electromagnetic field produced by the electromagnetic heating coil;

a coil holder positioned immediately outside of the cylindrical body of the cigarette holder where the electromagnetic heating coil is wound around; and a heat insulator surrounding the electromagnetic heating coil.

7. The electromagnetic vaporizer assembly of claim 6, wherein the cigarette holder comprises: aluminum (Al), Chromium (Cr), Manganese (Mn), Iron (Fe), Cobalt (Co), Nickel (Ni), Copper (Cu), Zirconium (Zr), Niobium (Nb), Molybdenur (Mo), Rhenium (Re), Silver (Ag), Cadmium (Cd), Tantalum (Ta), Tungsten (W), Iridium (Ir), Platinum (Pt), Gold (Au), and alloys of these materials.

8. The electromagnetic vaporizer assembly of claim 6, wherein the cigarette holder defines a plurality of venting openings on the closed bottom of the cigarette holder and on the side wall of the cylindrical body of the cigarette holder.

9. An electronic cigarette, comprising:

an electronic cigarette body to enclose the electronic cigarette, wherein the electronic cigarette body comprises a top end and a bottom end; and an electromagnetic vaporizer assembly having an electromagnetic vaporizer including an electromagnetic heating coil to heat a cigarette and an electromagnetic heating controller to allow a user to control and use the electronic cigarette, wherein when the user inserts the cigarette into a cigarette holder of the electronic cigarette, and presses a push button on the electronic cigarette, the electromagnetic heating controller provides a predetermined AC voltage to the electromagnetic heating coil to heat up the cigarette, and the user enjoys vaporized cigarette.

10. The electronic cigarette of claim 9, wherein the electronic cigarette body comprises:

an electronic cigarette top cover to cover the top end of the electronic cigarette body;

an electronic cigarette bottom cover to cover the bottom end of the electronic cigarette body; and a controller circuit support holding a DC power source, an electronic circuit board for the electromagnetic heating controller and a push button switch.

11. The electronic cigarette of claim 10, wherein the electromagnetic heating controller comprises:

a switch circuit to allow the user to turn on or off the DC power source to the electromagnetic vaporizer using the push button switch; and a DC to alternate-current (AC) converter to convert the DC power source to the predetermined AC voltage for driving the electromagnetic heating coil.

12. The electronic cigarette of claim 10, wherein the switch circuit comprises a push button switch, wherein the push button switch comprises two switching modes: a first push on and a second push off, and one push and hold on and release the hold off.

13. The electronic cigarette of claim 10, wherein the DC power source comprises a battery and a rechargeable battery.

14. The electronic cigarette of claim 9, wherein the cigarette comprises cigarette leaves, marijuana, tobacco wax, and electronic cigarette liquid (e-liquid).

15. The electronic cigarette of claim 9, wherein the electromagnetic vaporizer comprises:

the cigarette holder having a cylindrical body and a closed bottom, wherein the cigarette holder is made of low resistance metal to generate heat through electromagnetic field produced by the electromagnetic heating coil;

a coil holder positioned immediately outside of the cylindrical body of the cigarette holder where the electromagnetic heating coil is wound around; and a heat insulator surrounding the electromagnetic heating coil.

16. The electronic cigarette of claim 9, wherein the cigarette holder comprises: aluminum (Al), Chromium (Cr), Manganese (Mn), Iron (Fe), Cobalt (Co), Nickel (Ni), Copper (Cu), Zirconium (Zr), Niobium (Nb), Molybdenur (Mo), Rhenium (Re), Silver (Ag), Cadmium (Cd), Tantalum (Ta), Tungsten (W), Iridium (Ir), Platinum (Pt), Gold (Au), and alloys of these materials.

17. The electronic cigarette of claim 9, wherein the cigarette holder defines a plurality of venting openings on the closed bottom of the cigarette holder and on the side wall of the cylindrical body of the cigarette holder.

18. A method of using an electronic cigarette having an electromagnetic vaporizer assembly, comprising:

inserting, by a user, a cigarette into a cigarette holder of the electronic cigarette;

pressing, by the user, a push button on the electronic cigarette to turn on a DC power source to an electromagnetic heating controller;

generating, by the electromagnetic heating controller, a predetermined AC voltage to drive an electromagnetic heating coil of the electromagnetic vaporizer assembly; and vaporizing, by the electromagnetic vaporizer assembly, the cigarette to allow the user to enjoy the cigarette vapor.

19. The method of claim 18, wherein the cigarette comprises cigarette leaves, marijuana, tobacco wax, and electronic cigarette liquid (e-liquid).

20. The method of claim 18, wherein the electronic cigarette comprises:

an electronic cigarette body to enclose the electronic cigarette; and the electromagnetic vaporizer assembly having an electromagnetic vaporizer including an electromagnetic heating coil to heat the cigarette and the electromagnetic heating controller to provide the predetermined AC voltage to the electromagnetic heating coil and allow a user to control and use the electronic cigarette.

* * * * *